US007484997B2

(12) United States Patent
Hofling

(10) Patent No.: US 7,484,997 B2
(45) Date of Patent: Feb. 3, 2009

(54) COAXIAL PLUG-IN CONNECTOR FOR FITTING TO COAXIAL CABLE

(75) Inventor: Thomas Hofling, Grabenstatt (DE)

(73) Assignee: Rosenberger Hochfrequenztechnik GmbH & Co., Fridolfing (DE)

( * ) Notice: Subject to any disclaimer, the term of this patent is extended or adjusted under 35 U.S.C. 154(b) by 0 days.

(21) Appl. No.: 11/915,952

(22) PCT Filed: May 24, 2006

(86) PCT No.: PCT/EP2006/004990

§ 371 (c)(1),
(2), (4) Date: Nov. 29, 2007

(87) PCT Pub. No.: WO2006/128631

PCT Pub. Date: Dec. 7, 2006

(65) Prior Publication Data

US 2008/0200066 A1 Aug. 21, 2008

(30) Foreign Application Priority Data

May 30, 2005 (DE) ..... 20 2005 008 384 U

(51) Int. Cl.
*H01R 9/05* (2006.01)

(52) U.S. Cl. ..... 439/578

(58) Field of Classification Search ..... 439/578–585, 439/675

See application file for complete search history.

(56) References Cited

U.S. PATENT DOCUMENTS

| | | | | |
|---|---|---|---|---|
| 2003/0060082 | A1 * | 3/2003 | Korte et al. | 439/578 |
| 2006/0105628 | A1 * | 5/2006 | Montena | 439/578 |
| 2006/0264098 | A1 * | 11/2006 | Schneider | 439/578 |

FOREIGN PATENT DOCUMENTS

| | | | |
|---|---|---|---|
| DE | 20 2004 014843 | U1 | 11/2004 |
| EP | 0459664 | A | 12/1991 |
| EP | 1174948 | A | 1/2002 |
| GB | 1100786 | A | 1/1968 |

* cited by examiner

*Primary Examiner*—Edwin A. Leon
(74) *Attorney, Agent, or Firm*—DeLio & Peterson, LLC; Robert Curcio

(57) ABSTRACT

The invention relates to a coaxial plug-in connector for fitting to a coaxial cable, the coaxial plug-in connector having an inner conductor part (28), an outer conductor part (29) and an insulating part (10) having an axial through-hole (12) for the purpose of passing through the inner conductor part (28).

8 Claims, 3 Drawing Sheets

COAXIAL PLUG-IN CONNECTOR FOR FITTING TO COAXIAL CABLE

CROSS-REFERENCE TO RELATED APPLICATIONS

This application claims priority from PCT Application No. PCT/EP2006/004990 filed May 24, 2006, which claims priority from German Application No. DE 20 2005 008 384.4 filed May 30, 2005.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

The invention relates to a coaxial plug-in connector for fitting to a coaxial cable, the coaxial plug-in connector having an inner conductor part, an outer conductor part and an insulating part having an axial through-hole for the purpose of passing through the inner conductor part, in accordance with the introductory clause of claim 1.

2. Description of Related Art

For connecting coaxial cables with, for example, an electronic circuit on a printed circuit board, it is usual to fit a coaxial plug-in connector on one end of the coaxial cable. This coaxial plug-in connector usually comprises an inner conductor part, an outer part and an insulating part. There are various arrangements for the fitting strategy. For example, the inner conductor part is firstly pushed from an end on the insertion side through the insulating part and is only thereafter connected with a correspondingly exposed inner conductor of the coaxial cable. This is frequently necessary owing to the diameter relationships between the external diameter of the inner conductor part and the internal diameter of the insulating part, because it is not possible to push the inner conductor part through into the end of the insulating part on the coaxial cable side.

On the other hand, to simplify the fitting, it would be desirable to firstly fasten the inner conductor part on the inner conductor of the coaxial cable and only thereafter push the insulating part from the direction of the end on the insertion side over the inner conductor part. In so doing, however, increased difficulties arise, because the inner conductor part and the insulating part must be fixed with respect to each other in the axial direction.

BRIEF SUMMARY OF THE INVENTION

The invention is based on the problem of improving a coaxial plug-in connector of the above-mentioned type with regard to fitting on a coaxial cable.

This problem is solved according to the invention by a coaxial plug-in connector of the above-mentioned type with the features characterized in claim 1. Advantageous developments of the invention are described in the further claims.

Bearing in mind the problems and deficiencies of the prior art, it is therefore an object of the present invention to improve a coaxial plug-in connector of the above-mentioned type with regard to fitting on a coaxial cable.

BRIEF DESCRIPTION OF THE SEVERAL VIEWS OF THE DRAWING(S)

The invention is explained in further detail below with the aid of the drawings, in which.

DETAILED DESCRIPTION OF THE INVENTION

Figures 1, 2:
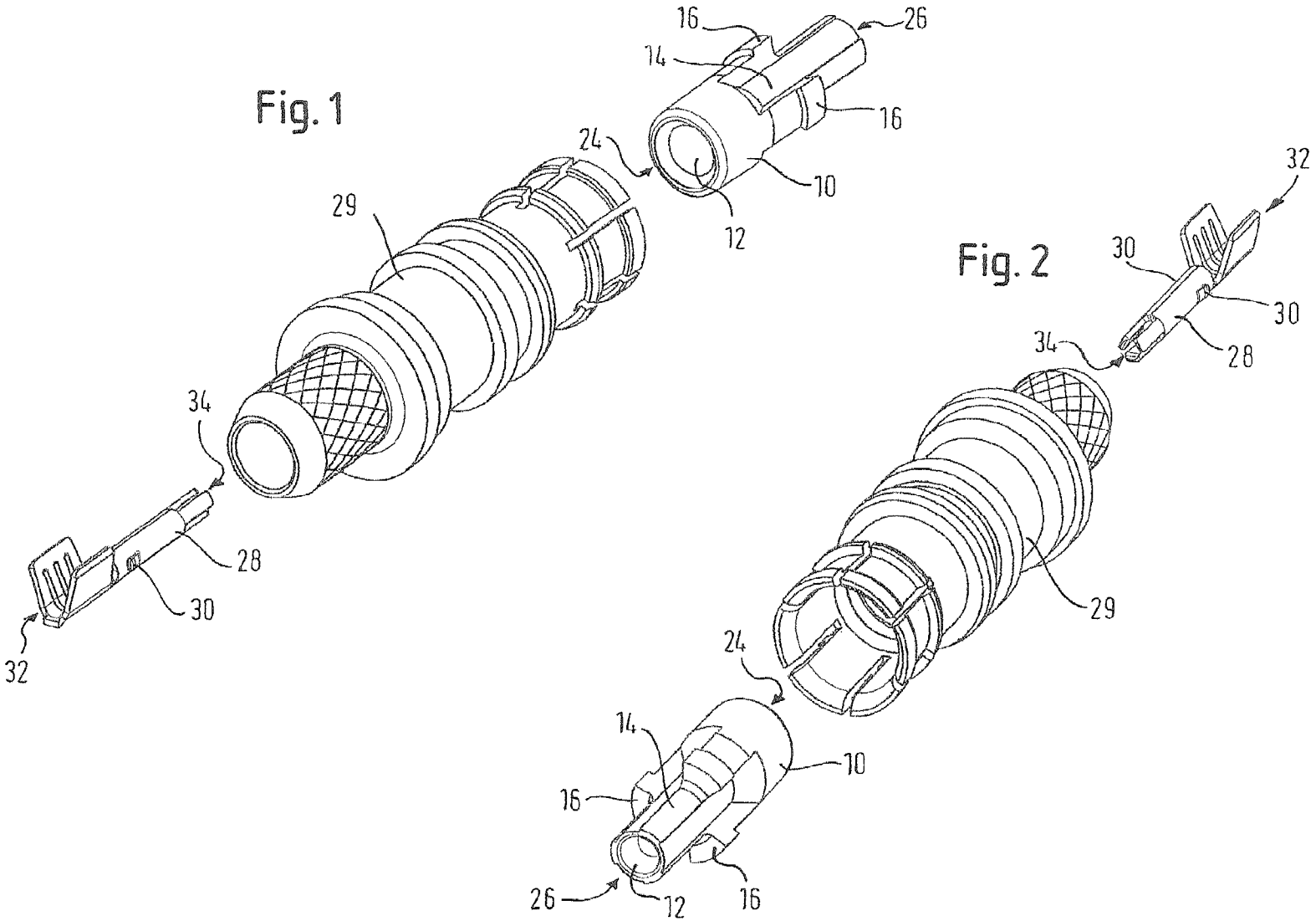
FIG. 1 shows a preferred embodiment of a coaxial plug-in connector in accordance with the invention, in exploded view.
FIG. 2 shows the coaxial plug-in connector according to FIG. 1 in a further exploded view.

In describing the preferred embodiment of the present invention, reference will be made herein to FIGS. 1-4 of the drawings in which like numerals refer to the like features of the invention.

In a coaxial plug-in connector of the above-mentioned type, provision is made in accordance with the invention that the inner conductor part has on its periphery N detent hooks with $N \geqq 2$, which are spaced apart from each other evenly in the peripheral direction, and that in the through-hole an edge is formed which divides the through-hole in the axial direction into a first section with a first diameter and into a second section with a second diameter which is greater than the first diameter, the first diameter being smaller and the second diameter being greater than the outer periphery of the inner conductor part, which is defined by outer surfaces of the detent hooks on the respective maximum radial elevation thereof, that in addition the insulating part has on its periphery $2n+(N-1)$ with $n \geqq 1$ recesses, which are spaced apart from each other evenly in the peripheral direction, overlap respectively both the first section and also the second section of the through-hole in the axial direction and are formed such that the wall of the through-hole is able to be deflected radially outwards elastically in the region of each recess.

This has the advantage that on insertion of the inner conductor part into the through-hole of the insulating part, at least one detent hook of the insulating part always lies in the region of a recess, i.e. an elastically deflectable wall of the through-hole, so that the inner conductor part is able to be inserted into the insulating part with less expenditure of force from the side of the first section with a smaller first diameter, in which at the same time, by cooperation of the detent hooks with the edge in the through-hole, a high degree of holding force is available against the inner conductor part being drawn out from the insulating part. Therefore, a low insertion force, which facilitates the fitting process, is combined with a high retaining force.

Expediently, the edge in the through-hole is formed so as to be radially encircling.

To assist the insertion of the inner conductor part into the insulating part, each detent hook is provided with an oblique surface which, viewed in the direction of insertion of the inner conductor part into the insulating part, falls from a maximum radial elevation of the detent hook radially inwards preferably up to the outer diameter of the inner conductor part.

Through the fact that the first section of the through-hole with a smaller diameter is formed so as to widen conically at an end facing away from the edge, an insertion of the inner conductor part into the through-hole is assisted with deflection of the wall of the through-hole, so that a low insertion force is the result.

Expediently, all the detent hooks are arranged in a plane perpendicularly to the axial longitudinal axis of the inner conductor part on the periphery of the inner conductor part.

The preferred embodiment of a coaxial plug-in connector in accordance with the invention which can be seen from FIG. 1 to 4 comprises an insulating part 10, an inner conductor part 28 and an outer conductor part 29. The insulating part 10 comprises an end 24 on the coaxial cable side and an end 26 on the insertion side. The inner conductor part 28 comprises an end 32 on the coaxial cable side and an end 34 on the insertion side.

The insulating part 10 is constructed in the form of a bushing with a through-hole 12 for the purpose of passing through the inner conductor part 28 of the coaxial plug-in connector, and comprises on its periphery three recesses 14 which are spaced apart evenly from each other. The latter are formed such that a wall of the through-hole 12 in the region of the recesses 14 is able to be deflected radially outwards elastically. Between the recesses 14, the insulating part 10 is provided with elevations 16 which, in cooperation with the outer conductor part 29, produce an engagement, securing the outer conductor part 29 and the insulating part 10 with respect to each other in the axial direction.

Figure 3:
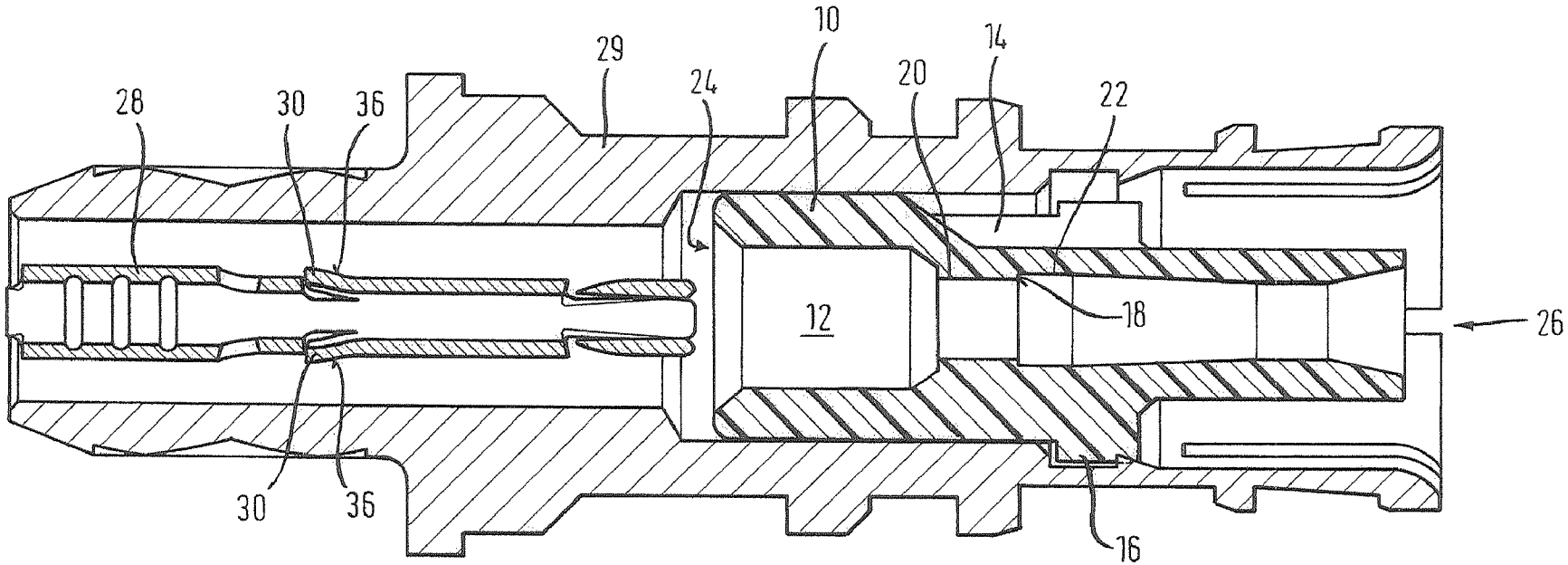
FIG. 3 shows the coaxial plug-in connector according to FIG. 1 with a partially inserted inner conductor part in a sectional view and FIG. 4 shows the coaxial plug-in connector according to FIG. 1 with a fully inserted inner conductor part in a sectional view.

As can be seen in particular from FIG. 3, the through-hole 12 of the insulating part 10 is divided by an edge 18 into a first section 20 with a first diameter and into a second section 22 with a second diameter which is greater than the first diameter. The first section 20 is formed so as to widen in a funnel shape at an end facing away from the edge 18. The end 24 of the insulating part 10 with the first section 20 forms an end 24 on the coaxial cable side which faces the coaxial cable in the fitted state. The end 26 of the insulating part 10 with the second section 22 forms an end 26 on the insertion side which forms a free end of the coaxial cable in the fitted state which is able to be inserted into a correspondingly complementary plug-in connector.

The inner conductor part 28 of the coaxial plug-in connector according to the invention comprises on its outer periphery two detent hooks 30 which are formed so as to be spaced apart from each other evenly in the peripheral direction, i.e. lying opposite each other. Each detent hook 30 rises from the outer periphery of the inner conductor part 28 in the radial direction and falls steeply, starting from a maximum radial elevation, in the direction of the end 32 of the inner conductor part 28 on the coaxial cable side, and falls in the direction of the end 34 of the inner conductor part 28 on the insertion side with an oblique surface 36 flatly up to the outer periphery of the inner conductor part 28.

The first diameter of the first section 20 of the through-hole 12 of the insulating part 10 is constructed smaller than the outer diameter of the inner conductor part 28, which is formed by the outer surfaces of the detent hooks 30 on the respective maximum radial elevation thereof. In contrast to this, the second diameter of the second section 22 of the through-hole 12 of the insulating part 10 is constructed larger than the above-mentioned outer diameter of the inner conductor part 28 in the region of the maximum radial elevation of the detent hooks 30. Hereby, as a whole, by cooperation of the detent hooks 30 with the edge 18, a detent- or locking mechanism is produced, which fixes the inner conductor part 28 relative to the insulating part 10 in the axial direction.

The inner conductor part 28 therefore comprises an even number of detent hooks 30, whereas the insulating part 10 has an odd number of recesses 14, the number of recesses 14 being greater by at least 1 than the number of detent hooks 30. As the detent hooks 30 on the one hand and the recesses 14 on the other hand are respectively spaced apart from each other evenly in the peripheral direction, the particular situation arises that on insertion of the inner conductor part 28 into the end 24 of the insulating part 10 on the coaxial cable side, irrespective of the position or alignment of the inner conductor part 28 relative to the insulating part 10 in the peripheral direction always at least one detent hook 30 of the inner conductor part 28 lies in the region of a recess 14 of the insulating part 10. Of course, the same situation can also be achieved in that an odd number of detent hooks 30 and an even number of recesses 14 are provided, in which the number of recesses 14 is greater by at least 1 than the number of detent hooks 30.

Figure 4:
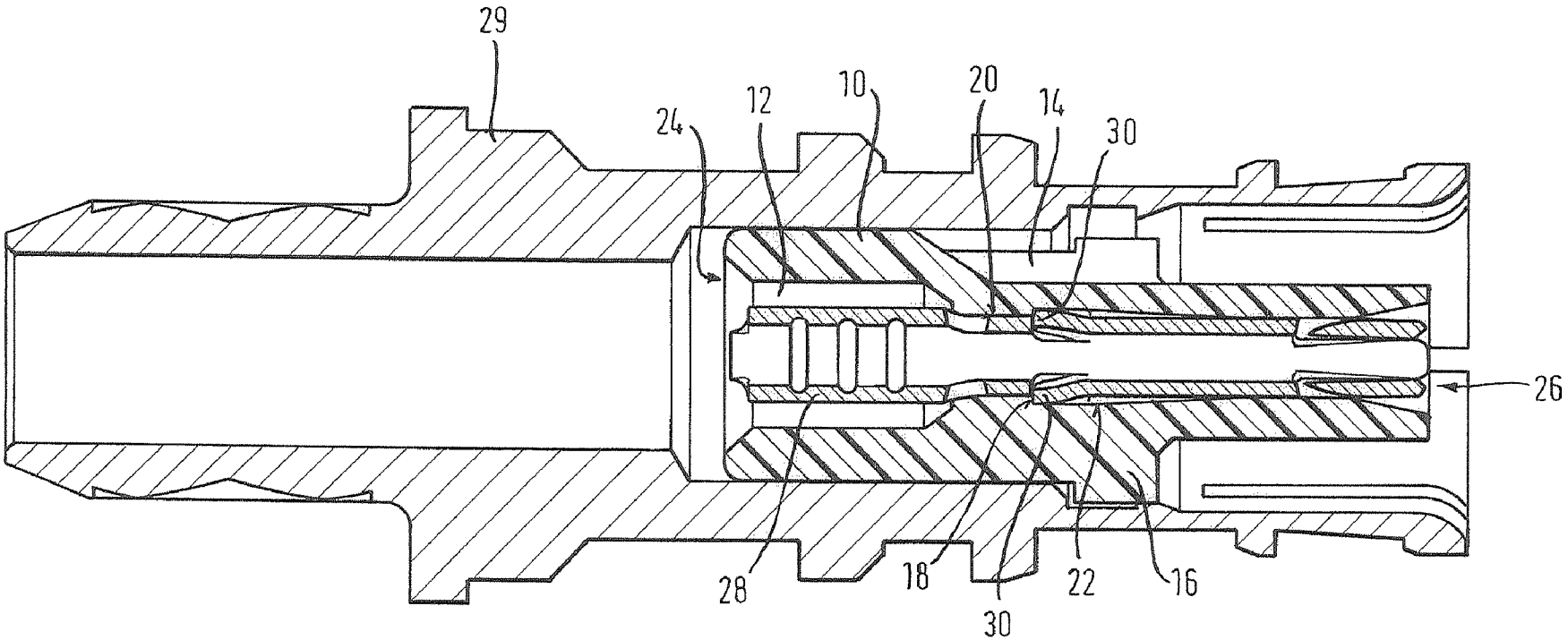

FIGS. 3 and 4 show the process of insertion of the inner conductor part 28 into the insulating part 10. One of the detent hooks 30 is situated in the region of a recess 14 on the outer periphery of the insulating part 10, whereby, supported by the funnel-shaped formation of the first section 20 of the through-hole 12 and the oblique surface 36 of the detent hook 30, the wall of the through-hole 12 of the insulating part 10 is bent radially outwards elastically so that the detent hooks 30 can pass the narrow first section 20 of the through-hole 12. As soon as the detent hooks 30 reach the edge 18, the wall of the through-hole 12 of the insulating part 10 springs back and the edge 18 prevents an axial pushing back of the inner conductor part 28 in the direction of the end of the insulating part 10 on the coaxial cable side. Through the arrangement according to the invention of recesses 14 and detent hooks 30, only a small expenditure of force is necessary for pushing in the inner conductor part 28 into the end 24 of the insulating part 10 on the coaxial cable side. However, in reverse, through the cooperation of the steep flanks of the edge 18 and the detent hooks 30, an extremely great force would be necessary in order to draw the inner conductor part 28 out again in the direction of the end 24 of the insulating part 10 on the coaxial cable side. Therefore, with a small fitting force, a high holding force is ensured in the axial direction.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

Thus, having described the invention, what is claimed is:

1. A coaxial plug-in connector for fitting to a coaxial cable, the coaxial plug-in connector comprising:

an inner conductor part having an outer periphery, and including N detent hooks with N greater than or equal to 2 on said outer periphery, said detent hooks spaced apart from each other evenly in peripheral direction;

an outer conductor part; and an insulating part including an axial through-hole for passing through the inner conductor part, wherein said through-hole includes an edge dividing said through-hole in the axial direction into a first section with a first diameter and into a second section with a second diameter which is greater than the first diameter, the first diameter being smaller and the second diameter being greater than the outer periphery of the inner conductor part which is defined by outer surfaces of the detent hooks on a respective maximum radial elevation thereof, that in addition the insulating part has on its periphery 2n+(N−1) recesses with n greater than or equal to 1, said recesses spaced apart from each other evenly in the peripheral direction, and overlap respectively both the first section and the second section of the through-hole in the axial direction and are formed such that the wall of the through-hole is able to be deflected radially outwards elastically in the region of each recess.

2. The coaxial plug-in connector according claim 1, including having the first section of the through-hole with a smaller diameter formed so as to widen conically at an end facing away from the edge.

3. The coaxial plug-in connector of claim 1, including having all the detent hooks arranged in a plane perpendicularly to the axial longitudinal axis of the inner conductor part on the periphery of the inner conductor part.

4. The coaxial plug-in connector of claim 1, including having the edge in the through-hole formed so as to be radially encircling.

5. The coaxial plug-in connector according claim 4, including having the first section of the through-hole with a smaller diameter formed so as to widen conically at an end facing away from the edge.

6. The coaxial plug-in connector of claim 4, including having all the detent hooks arranged in a plane perpendicularly to the axial longitudinal axis of the inner conductor part on the periphery of the inner conductor part.

7. The coaxial plug-in connector of claim 1 including having each detent hook provided with an oblique surface which, viewed in the direction of insertion of the inner conductor part into the insulating part, falls radially inwards from a maximum radial elevation of the detent hook.

8. The coaxial plug-in connector of claim 7, wherein the oblique surface falls radially up to the outer diameter of the inner conductor part.

* * * * *